US008497603B2

(12) United States Patent
Hsu et al.

(10) Patent No.: US 8,497,603 B2
(45) Date of Patent: Jul. 30, 2013

(54) PORTABLE ELECTRONIC APPARATUS AND CONNECTION METHOD THEREFOR

(75) Inventors: Chia-Wei Hsu, Taoyuan (TW); Yu-Peng Lai, Taoyuan (TW); Chia-Hsing Liao, Taoyuan (TW); Ching-Chung Hung, Taoyuan (TW); Wei-Syuan Lin, Taoyuan (TW)

(73) Assignee: HTC Corporation, Taoyuan (TW)

( * ) Notice: Subject to any disclaimer, the term of this patent is extended or adjusted under 35 U.S.C. 154(b) by 904 days.

(21) Appl. No.: 12/623,475

(22) Filed: Nov. 23, 2009

(65) Prior Publication Data

US 2010/0169529 A1 Jul. 1, 2010

(30) Foreign Application Priority Data

Dec. 31, 2008 (TW) ..... 97151679 A

(51) Int. Cl.
*H01H 35/00* (2006.01)
*H01H 83/00* (2006.01)

(52) U.S. Cl.
USPC ..... 307/116; 439/188

(58) Field of Classification Search
USPC ..... 307/116, 125, 126, 127
See application file for complete search history.

(56) References Cited

U.S. PATENT DOCUMENTS 6,856,046 B1 * 2/2005 Scarlett et al. ..... 307/125
2008/0164994 A1 7/2008 Johnson et al.

FOREIGN PATENT DOCUMENTS

TW 200843250 11/2008

OTHER PUBLICATIONS

Office Action from corresponding Taiwanese Application No. 097151679 dated Oct. 20, 2011.

* cited by examiner

*Primary Examiner* — Rexford Barnie
*Assistant Examiner* — Toan Vu
(74) *Attorney, Agent, or Firm* — Grossman, Tucker, Perreault & Pfleger, PLLC

(57) ABSTRACT

A portable electronic apparatus and a connection method therefore are disclosed. The portable electronic apparatus comprises a connector, a processing circuit, and a switch module. After a plug is plugged into the connector, the processing circuit reads a voltage value of the plug via the switch module. When determining that the voltage value of the plug is within a first voltage range, the processing circuit outputs switch signals to the switch module, so that an input signal of the plug is able to be transmitted to the processing circuit via the connector and the switch module. When determining that the voltage value of the plug is within a second voltage range, the processing circuit outputs other switch signals to the switch module, so that an output signal of the processing circuit is able to be transmitted to the plug via the switch module and the connector.

16 Claims, 7 Drawing Sheets

PORTABLE ELECTRONIC APPARATUS AND CONNECTION METHOD THEREFOR

This application claims the benefit of priority based on Taiwan Patent Application No. 097151679, filed on Dec. 31, 2008, the contents of which are incorporated herein by reference in its entirety.

CROSS-REFERENCES TO RELATED APPLICATIONS

Not applicable.

FIELD

The present invention relates to a portable electronic apparatus and a connection method therefor. More specifically, the present invention relates to a portable electronic apparatus that requires only a single connector to transmit an output signal or an input signal and a connection method therefor.

BACKGROUND

With the advancement of science and technology, various electronic products have become indispensable tools in modern people's life. These electronic products can not only assist users in performing various complicated operations, but also provide users with a variety of entertainment functions, such as watching movies, listening to music or enjoying Internet voice communication services. Furthermore, in order to provide commuters or users who are outside some audio/video (AV) entertainments, portable electronic products with AV functions have also been developed, such as mobile phones with music playing functions or walkmans capable of outputting movies to other display devices. Driven by market needs, mobile phone manufacturers have researched and developed mobile phones with music playing functions that are capable of outputting movies to other display devices.

Video output signals of images, audio output signals of voices and audio input signals of microphones have different transmission directions, and their attributes are not all the same. Hence, it usually takes two different types connectors for a single electronic product to provide all the functions of outputting images and voice signals and inputting microphone signals, wherein the two connectors connect with a plug for outputting video image signals and another plug for outputting/inputting voice/microphone audio signals respectively.

More specifically, to enable a mobile phone to output video image signals and output/input voice/microphone audio signals, manufacturers typically use a TV-OUT connector for connection with a display device, so that video image signals can be outputted to the display device via the TV-OUT connector. On the other hand, the manufacturers may adopt a 3.5 mm/2.5 mm audio connector for connection with an earphone or an earphone with a microphone function, so that audio output signals can be outputted to the earphone or microphone audio input signals can be inputted to the mobile phone via the 3.5 mm/2.5 mm audio connector.

However, if video image output signals, audio output signals and microphone audio input signals are transmitted in a mobile phone by the aforesaid manner, the user must bring multiple kinds of connection lines, which causes a considerable inconvenience to the user. Meanwhile, as mobile phones continuously become more compact, fabricating two connectors in a single mobile phone would occupy a certain space and consequently decrease the available space for other electronic components, thus imposing more specification limitations. In view of the above shortcomings and facts, it is important to provide diversified signal transmission modes in an electronic product with the AV entertainment functions, while maintaining the compact size of the electronic product without additional limitations.

SUMMARY

One objective of this invention is to provide a portable electronic apparatus and a connection method therefore. After a plug is plugged into a connector, the portable electronic apparatus can transmit an output signal or receive an input signal according to the type of the plug.

To this end, the portable electronic apparatus comprises a connector, a processing circuit and a switch module. The connector is configured to connect a plug. The processing circuit is electronically connected to the connector and configured to detect whether the plug is plugged into the connector. When the plug is plugged into the connector and detected, the processing circuit generates a first switch signal. The switch module is configured to receive the first switch signal and to form a first connection path according to the first switch signal, so that the plug and the processing circuit are electronically connected. Then, the processing circuit reads a voltage value of the plug via the first connection path and generates a second switch signal according to the voltage value. The switch module forms a second connection path according to the second switch signal, so that the plug and the processing circuit are electronically connected. The processing circuit transmits an input signal from the plug or an output signal from the processing circuit via the second connection path.

Also, to this end, the connection method comprises the following steps: detecting whether a plug is plugged into the connector; generating a first switch signal when the plug is plugged into the connector; enabling the switch module to form a first connection path according to the first switch signal so that the plug and the processing circuit are electronically connected; reading a voltage value of the plug via the first connection path; generating a second switch signal according to the voltage value; enabling the switch module to form a second connection path according to the second switch signal, so that the plug and the processing circuit are electronically connected; and transmitting an input signal from the plug or an output signal from the processing circuit via the second connection path.

With the aforesaid configurations, the portable electronic apparatus and the connection method therefore disclosed in this invention only require a single connector to form an appropriate connection path by reading a voltage value of the plug connected to the connector. As a result, audio output signals and either video image output signals or microphone audio input signals can be transmitted through the single connector. Thus, more than one kind of connector is no longer needed for transmission of the aforesaid output/input signals.

The detailed technology and preferred embodiments implemented for the subject invention are described in the following paragraphs accompanying the appended drawings for people skilled in this field to well appreciate the features of the claimed invention.

DETAILED DESCRIPTION

Figure 1:
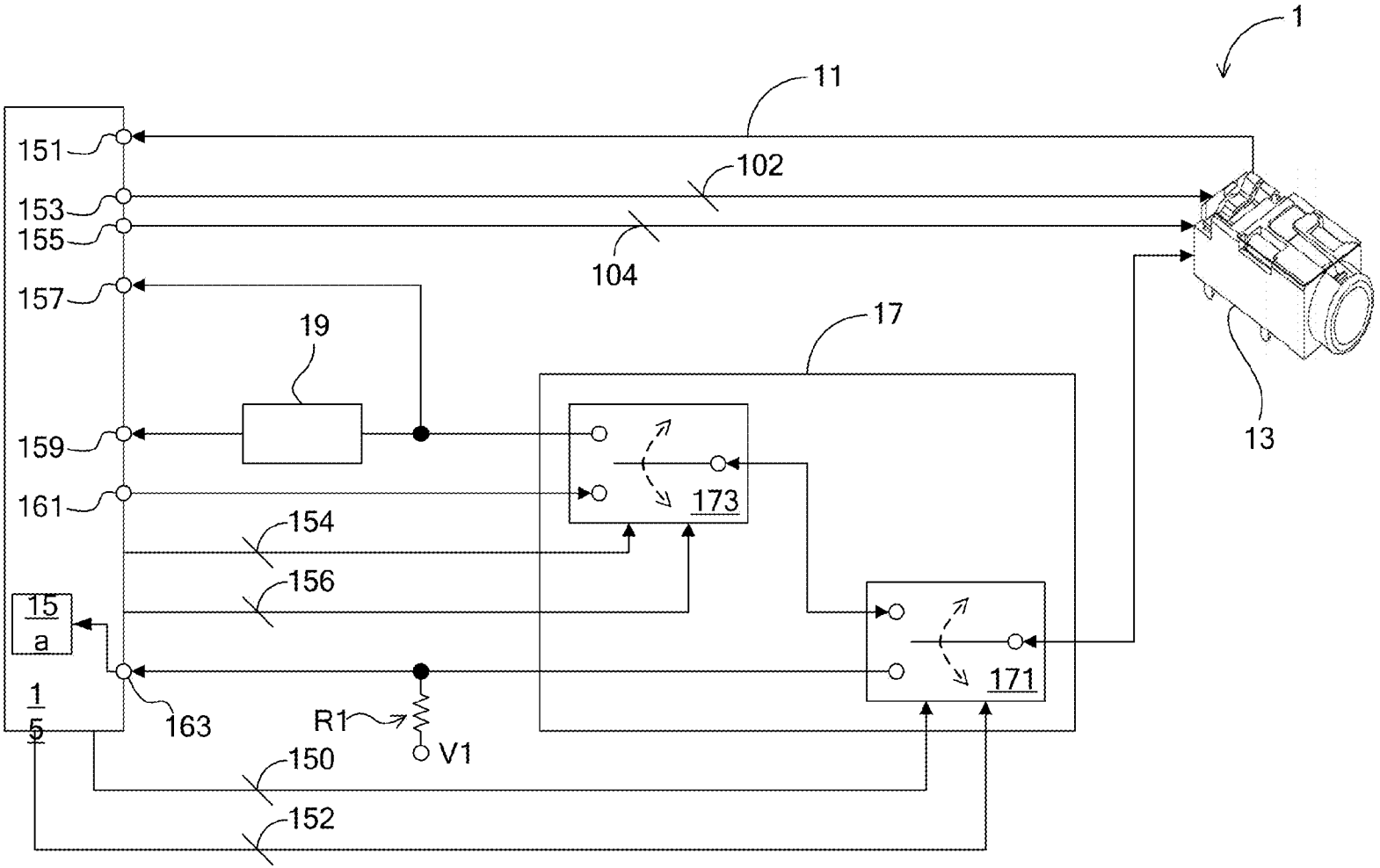
FIG. 1 is a schematic view of a portable electronic apparatus according to a preferred embodiment of this invention.
Figure 2C:
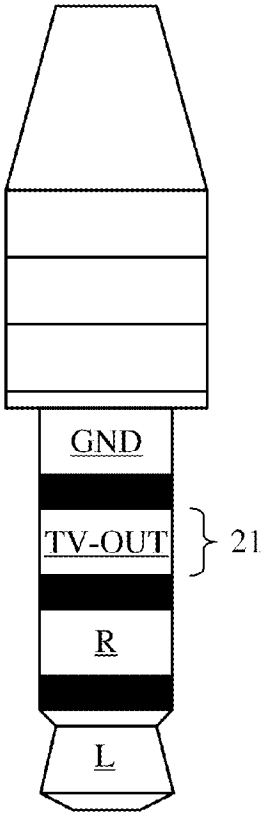
FIG. 2C is a schematic view of a stereo output plug with a TV output function.
Figure 2B:
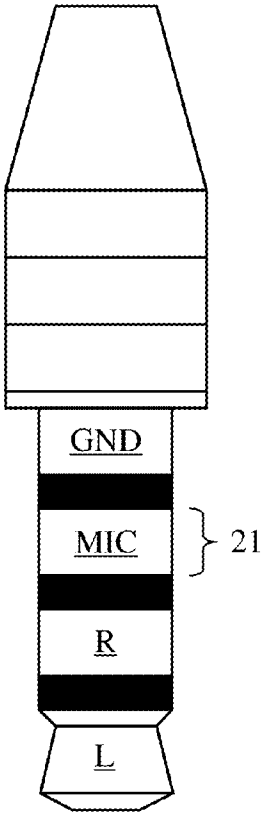
FIG. 2B is a schematic view of a stereo earphone plug with a microphone function.
Figure 2A:
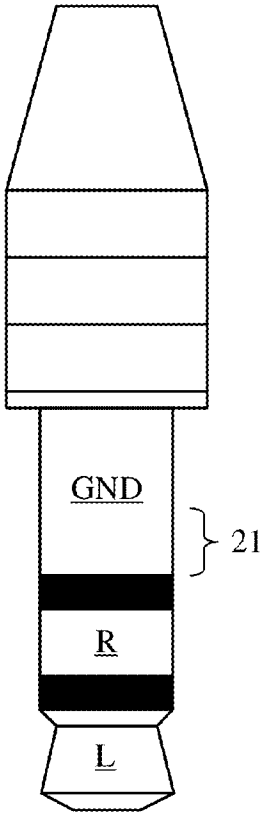
FIG. 2A is a schematic view of a stereo earphone plug.

FIG. 1 is a portable electronic apparatus 1 according to a preferred embodiment of this invention. The portable electronic apparatus 1 may be any kind of multimedia audio and video (AV) electronic product, such as a notebook computer, a personal digital assistant (PDA), a cellphone, a digital camera, a high-level mobile phone and the like. The portable electronic apparatus 1 comprises a connector 13, a processing circuit 15, a switch module 17, an external circuit 19 and a pull-up resistor R1. The connector 13 can be a 3.5 mm earphone connector or a 2.5 mm earphone connector. In this preferred embodiment, the connector 13 may connect any kinds of plug depicted in FIGS. 2A, 2B and 2C. FIG. 2A depicts a stereo earphone plug, which has a ground contact GND, a right sound channel contact R and a left sound channel contact L. FIG. 2B depicts a stereo earphone plug with a microphone function, which further has a microphone contact MIC in addition to the ground contact GND, the right sound channel contact R and the left sound channel contact L. FIG. 2C depicts a stereo output plug with a TV output function, which further has a TV output contact TV-OUT in addition to the ground contact GND, the right sound channel contact R and the left sound channel contact L. All of these plugs may be made in accordance with the 3.5 mm or 2.5 mm standards that are compatible with the dimensions of the connector 13. The aforesaid plugs and connector may be readily made by those of ordinary skill in the art, and thus will not be further described herein.

The processing circuit 15 comprises a plug detection contact 151, a right sound channel audio output contact 153, a left sound channel audio output contact 155, a microphone audio input contact 157, a microphone audio interruption detection contact 159, a TV output contact 161, a plug voltage input contact 163 and an analog to digital converter (ADC) 15*a*. The plug detection contact 151 is electronically connected to the connector 13 via a connection line 11 to detect whether a plug is plugged into the connector 13. The switch module 17 comprises a first switch unit 171 and a second switch unit 173. The first switch unit 171 can selectively connect the connector 13 electronically to the plug voltage input contact 163 of the processing circuit 15 or the second switch unit 173. The second switch unit 173 can selectively connect the first switch unit 171 electronically to the microphone audio input contact 157 or the TV output contact 161 of the processing circuit 15, and is electronically connected to the microphone audio interruption detection contact 159 of the processing circuit 15 via the external circuit 19. The pull-up resistor R1 is electronically connected to the plug voltage input contact 163 and a predetermined voltage V1.

Figure 3:
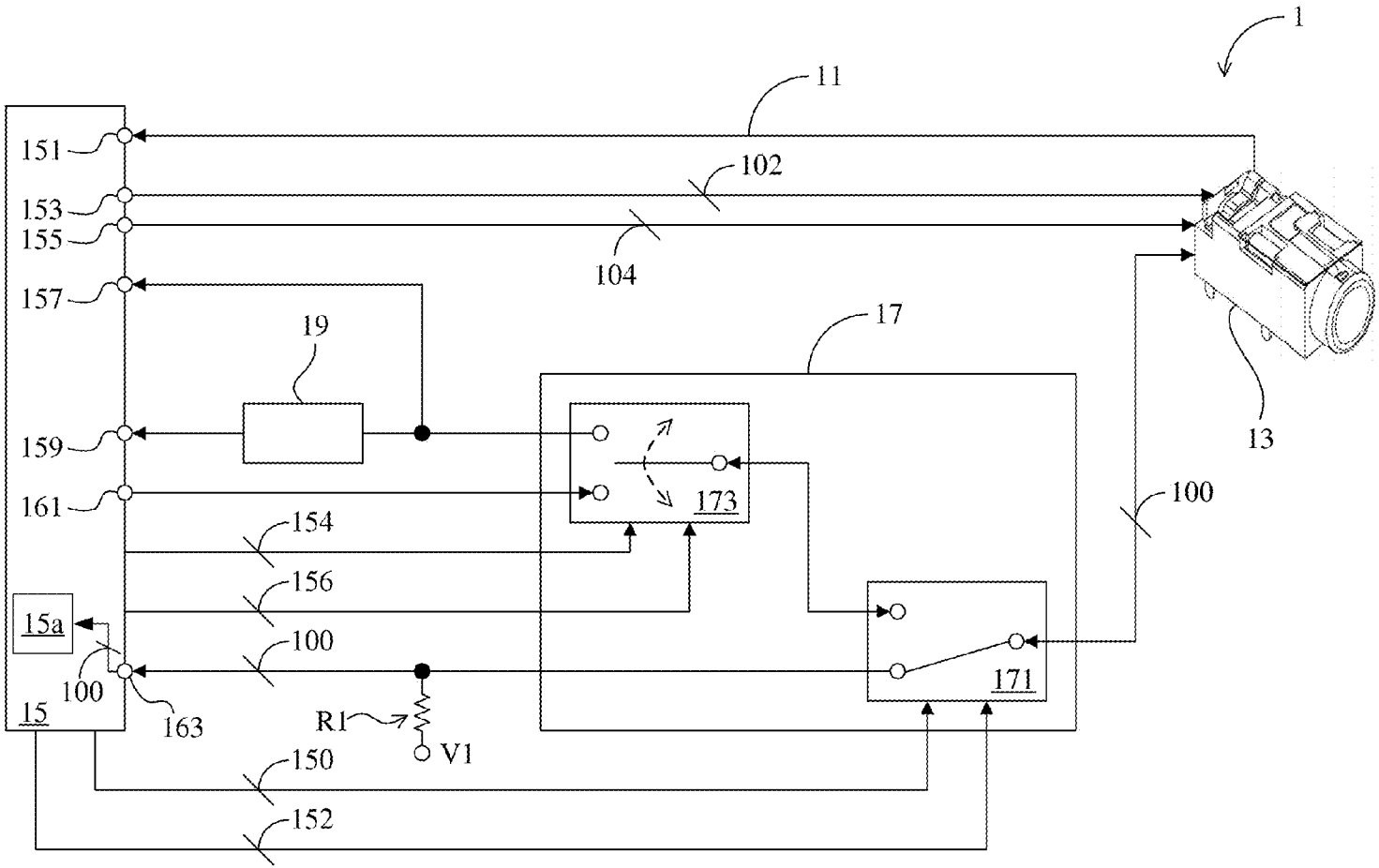
FIG. 3 is a schematic view illustrating how the portable electronic apparatus reads a voltage value of a plug.

When a stereo earphone plug, a stereo earphone plug with a microphone function or a stereo output plug with a TV output function as depicted in FIGS. 2A, 2B, 2C is plugged into the connector 13, the processing circuit 15 will detect that a plug has been plugged into the connector 13 via the plug detection contact 151 and the connection line 11. Then, the processing circuit 15 generates and outputs a first switch signal 150 to the first switch unit 171 to form a first connection path. As shown in FIG. 3, according to the first switch signal 150, the first switch unit 171 will electronically connect the connector 13 to the plug voltage input contact 163 of the processing circuit 15 (i.e., forming the first connection path), so that the processing circuit 15 can read a voltage value 100 from the plug contact 21 of the plug (shown in FIGS. 2A, 2B and 2C) via the plug voltage input contact 163. After the voltage value 100 is read by the processing circuit 15, the ADC 15*a* converts the voltage value 100 into a digital value, from which the type of plug plugged into the connector 13 can be determined. It should be noted that the operation implemented by the ADC 15*a* to convert the voltage value 100 into a digital value is well known to those of ordinary skill in the art, and thus will not be further described herein.

Figure 4:
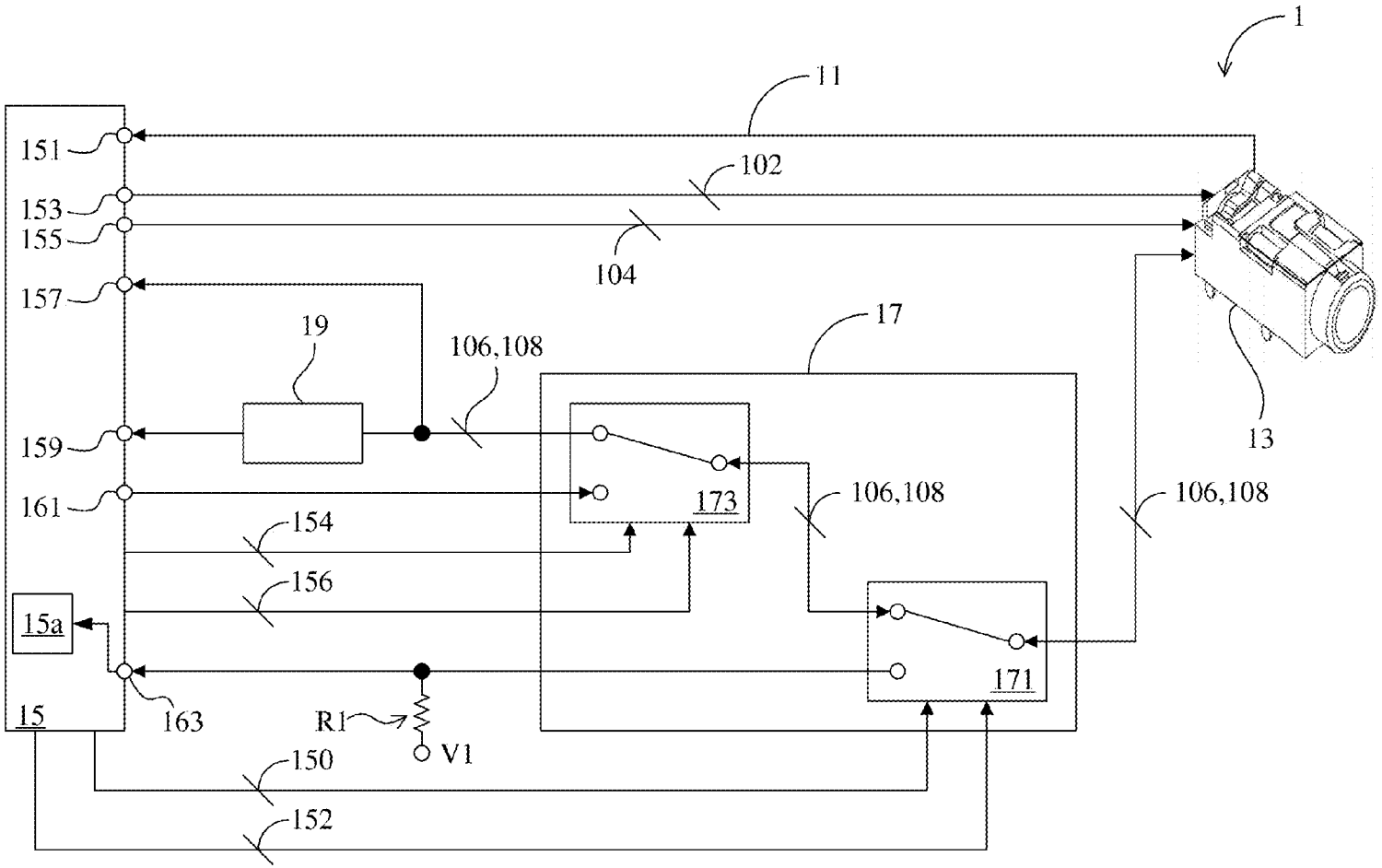
FIG. 4 is a schematic view illustrating a state when the stereo earphone plug/the stereo earphone plug with a microphone function is plugged into the connector of the portable electronic apparatus.

Hereinafter, the corresponding operations of individual components in the portable electronic apparatus 1 for different kinds of plugs plugged into the connector 13 will be sequentially described. In reference to FIGS. 2A and 3, when a plug as depicted in FIG. 2A is plugged into the connector 13, the processing circuit 15 reads the voltage value 100 of the stereo earphone plug contact 21 via the plug voltage input contact 163, as shown in FIG. 3. In this embodiment, if the voltage value 100 read by the processing circuit 15 is a first predetermined value (e.g., 0 V), then the ADC 15*a* converts the value of 0 V into a digital value (e.g., "00000000"). Next, according to the digital value of "00000000", the processing circuit 15 determines that the plug plugged into the connector 13 is a stereo earphone plug. In reference to FIGS. 2A and 4, after the processing circuit 15 determines that the plug is a stereo earphone plug, the processing circuit 15 generates and outputs a second switch signal 152 to the first switch unit 171 so that the first switch unit 171 electronically connects the connector 13 to the second switch unit 173 according to the second switch signal 152, and the processing circuit 15 then generates and outputs a third switch signal 154 to the second switch unit 173 so that the second switch unit 173 electronically connects the first switch unit 171 to the microphone audio input contact 157 according to the third switch signal 154. Afterwards, the processing circuit 15 outputs a right sound channel audio signal 102 to the right sound channel contact R of the stereo earphone plug via the right sound channel audio output contact 153 and also outputs a left sound channel audio signal 104 to the left sound channel contact L of the stereo earphone plug via the left sound channel audio output contact 155. Thereby, the stereo earphone plug as depicted in FIG. 2A will receive a stereo audio signal comprising the right sound channel audio signal 102 and the left sound channel audio signal 104.

Next, in reference to FIGS. 2B and 3, when a plug with a microphone function as depicted in FIG. 2B is plugged into the connector 13, the processing circuit 15 reads the voltage value 100 of the contact 21 of the stereo earphone plug with the microphone function via the plug voltage input contact 163. In this embodiment, if the voltage value 100 read by the processing circuit 15 is within a first voltage range (e.g., 0.3 to 2.5 V), then the ADC 15*a* converts the value of 0.3 to 2.5 V into a digital value (e.g., "00011110" to "11110101"). Next, according to the digital value of "00011110" to "11110101", the processing circuit 15 determines that the plug plugged into the connector 13 is a stereo earphone plug with a microphone function. Now, referring to FIGS. 2B and 4, after the processing circuit 15 determines that the plug is a stereo earphone plug with a microphone function, the processing circuit 15 generates and outputs a second switch signal 152 to the first switch unit 171 so that the first switch unit 171 electronically connects the connector 13 to the second switch unit 173 according to the second switch signal 152, and the processing circuit 15 then generates and outputs a third switch signal 154 to the second switch unit 173 so that the second switch unit 173 electronically connects the first switch unit 171 to the microphone audio input contact 157 according to the third switch signal 154, thereby forming a second connection path. Meanwhile, the second switch unit 173 is electronically connected to the microphone audio interruption detection contact 159 of the processing circuit 15 via the external circuit 19.

After the detection contact 151 detects that a plug has been plugged into the connector 13, if the microphone audio interruption detection contact 159 detects, within a predetermined time interval (e.g., within 10 seconds), a microphone interruption instruction 106 from the contact 21 (shown in FIG. 2B) via the external circuit 19 and the electrical connection path of the switch module 17, this means that the stereo earphone plug with the microphone function is able to operate normally. Then, the microphone contact MIC will transmit a microphone audio input signal 108 to the microphone audio input contact 157 of the processing circuit 15 via the first switch unit 171 and the second switch unit 173.

Likewise, the processing circuit 15 outputs a right sound channel audio signal 102 to the right sound channel contact R of the stereo earphone plug via the right sound channel audio output contact 153 and also outputs a left sound channel audio signal 104 to the left sound channel contact L of the stereo earphone plug via the left sound channel audio output contact 155. Thereby, in addition to transmitting the microphone audio input signal 108 to the processing circuit 15, the stereo earphone plug with the microphone function as depicted in FIG. 2B can also receive a stereo audio signal comprising the right sound channel audio signal 102 and the left sound channel audio signal 104 from the processing circuit 15.

More specifically, the microphone audio interruption detection contact 159 of the processing circuit 15 periodically detects whether a microphone interruption instruction 106 is received from the plug via the external circuit 19 to ensure that the user is still using the microphone function. If the microphone audio interruption detection contact 159 can still receive the microphone interruption instruction 106, then the microphone contact MIC continues to transmit the microphone audio input signal 108 to the microphone audio input contact 157 of the processing circuit 15 via the first switch unit 171 and the second switch unit 173. On the other hand, if the microphone audio interruption detection contact 159 does not receive the microphone interruption instruction 106 within the predetermined time (i.e., 10 seconds), it implies that the plug only receives the right sound channel audio signal 102 and the left sound channel audio signal 104 from the processing circuit 15.

Figure 5:
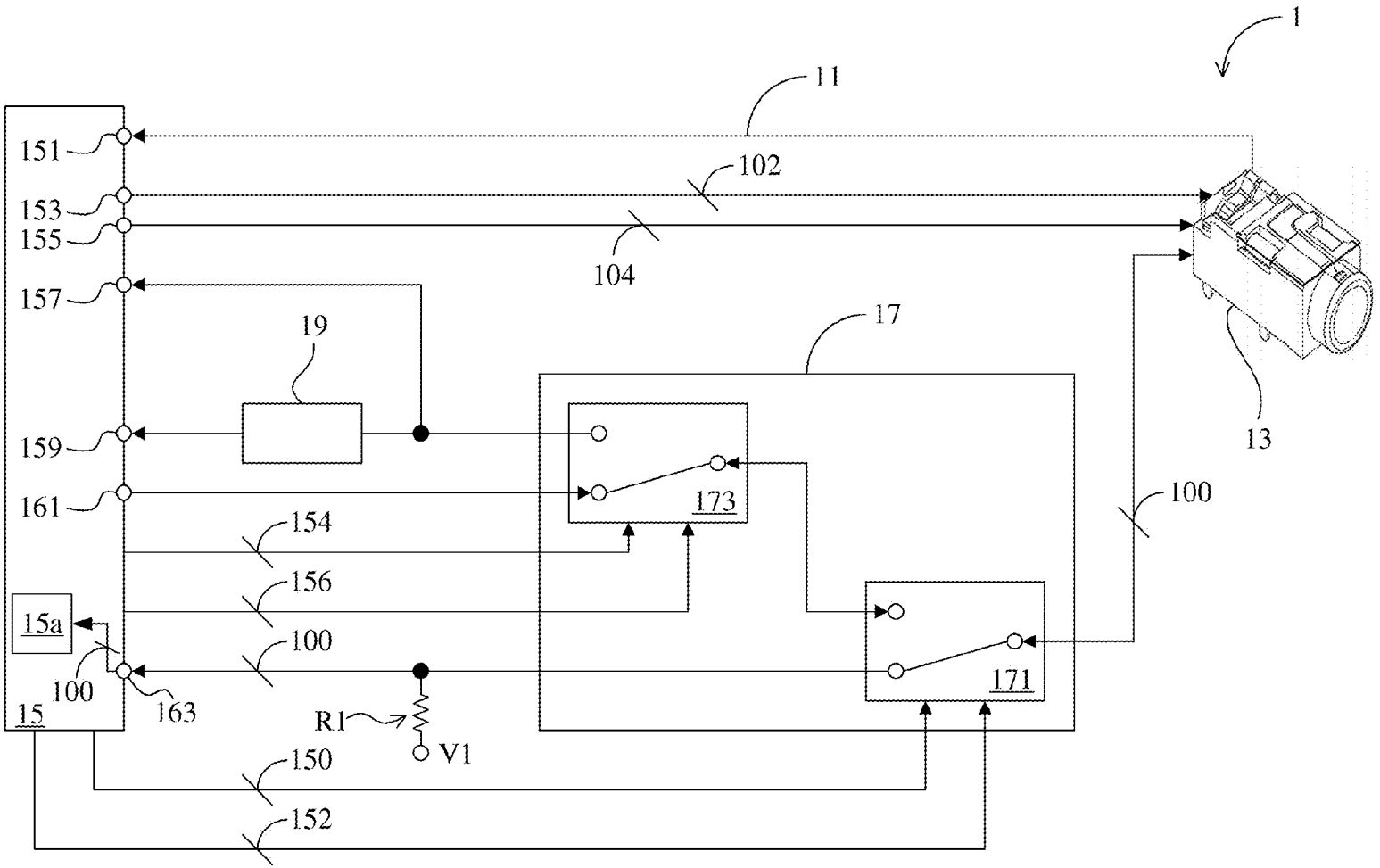
FIG. 5 is a schematic view illustrating a state when the stereo output plug with a TV output function but has not been connected to a display device is plugged into the connector of the portable electronic apparatus.

With reference to FIGS. 2C and 3, when a stereo output plug with a TV output function as depicted in FIG. 2C is plugged into the connector 13 and has not been connected to an external display device (not shown), the contact 21 of the plug will be in a floating state. In the meantime, the voltage value 100 read by the processing circuit 15 will be pulled up by the pull-up resistor R1 to a voltage value supplied by the predetermined voltage V1. In this preferred embodiment, the predetermined voltage V1 supplies a voltage of a second predetermined value (e.g., 2.6 V). Hence, the voltage value 100 will be pulled up by the pull-up resistor R1 to 2.6 V, which is then converted by the ADC 15*a* of the processing circuit 15 into a digital value (e.g., "11111111"). According to the digital value of "11111111", the processing circuit 15 then determines that the plug plugged into the connector 13 is a floated stereo output plug. With reference to FIGS. 2C and 5, after determining that the plug is a floated stereo output plug, the processing circuit 15 generates and outputs a first switch signal 150 to the first switch unit 171 so that the first switch unit 171 electronically connects the connector 13 and the plug voltage input contact 163 according to the first switch signal 150, and the processing circuit 15 also generates and outputs a fourth switch signal 156 to the second switch unit 173 so that the second switch unit 173 electronically connects the second switch unit 173 to the TV output contact 161 according to the fourth switch signal 156.

If the voltage value 100 read by the plug voltage input contact 163 of the processing circuit 15 is 2.6 V, the portable electronic apparatus 1 will inform the user through various manners (e.g., through screen displaying or sound alerting) that the stereo output plug with the TV output function plugged in the connector 13 has not been connected to any external display device.

Also, it should be noted that this invention has no limitation on the resistance value of the pull-up resistor R1 and the voltage value (i.e., the second predetermined value) supplied by the predetermined voltage V1; those of ordinary skill in the art may use a different resistance value of the pull-up resistor R1 and a different voltage value supplied by the predetermined voltage V1 in combination to accomplish a desired function, and therefore, this will not be further described herein.

Figure 6:
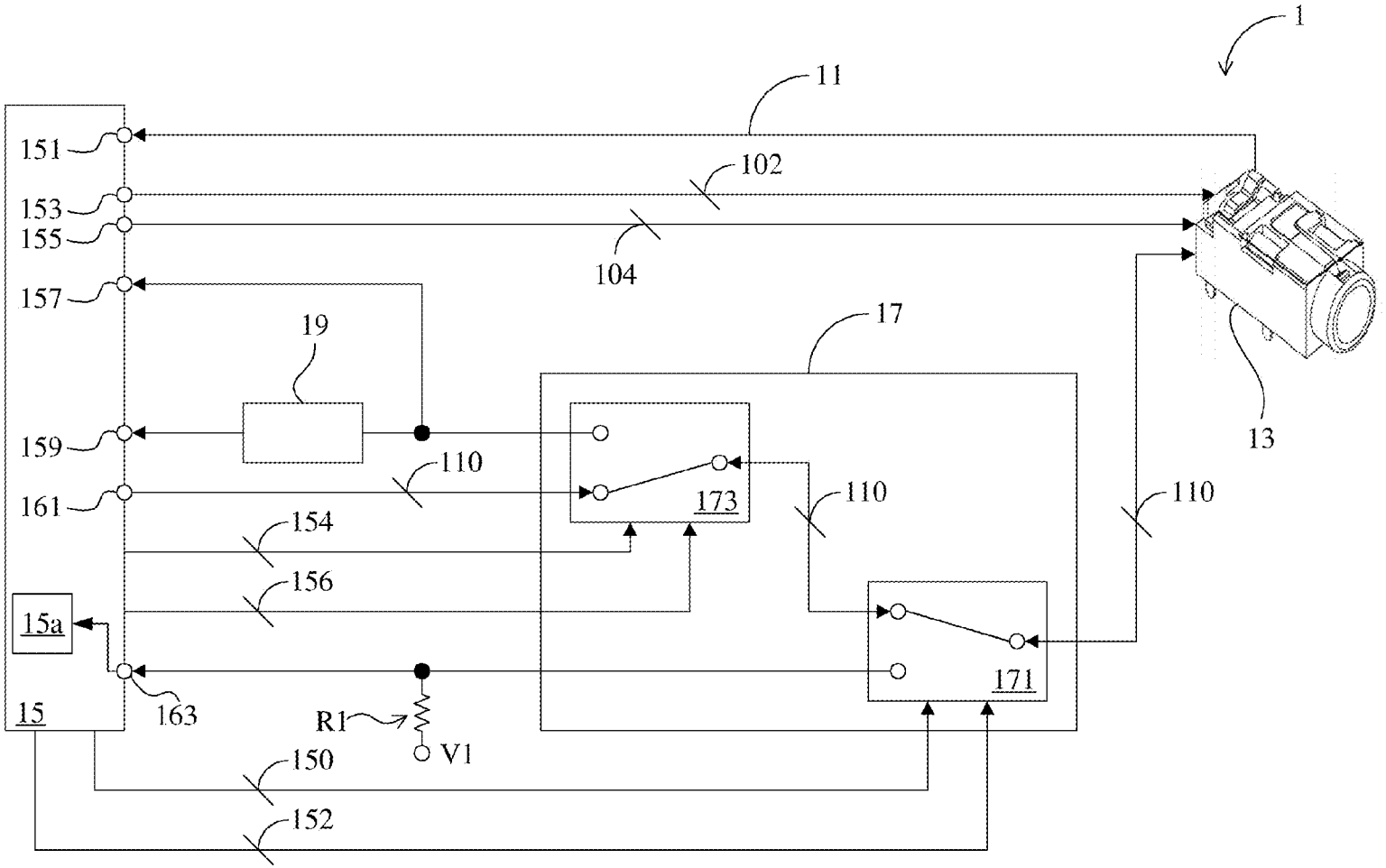
FIG. 6 is a schematic view illustrating a state when the stereo output plug with a TV output function and has been connected to a display device is plugged into the connector of the portable electronic apparatus.

In reference to FIGS. 2C and 5, after a stereo output plug with the TV output function has been connected to an external display device, the voltage value 100 of the contact 21 will fall within a second voltage range (e.g., 0.12 to 0.2 V). In this case, the ADC 15*a* of the processing circuit 15 converts the value of 0.12 to 0.2 V into a digital value (e.g., "00001100" to "00010100"). According to the digital value of "00001100" to "00010100", the processing circuit 15 determines that the floating plug plugged into the connector 13 has been connected to an external display device, which means that the stereo output plug with the TV output function is now able to operate normally. Next, referring to FIGS. 2C and 6, after determining that the floating plug has been connected to an external display device, the processing circuit 15 generates and outputs a second switch signal 152 to the first switch unit 171 so that the first switch unit 171 electronically connects the connector 13 to the second switch unit 173 according to the second switch signal 152, and the processing circuit 15 also generates and outputs a fourth switch signal 156 to the second switch unit 173 so that the second switch unit 173 electronically connects the first switch unit 171 to the TV output contact 161 according to the fourth switch signal 156, thereby forming another second connection path. Meanwhile, the TV output contact 161 of the processing circuit 15 transmits a TV output signal 110 to the TV output contact TV-OUT of the stereo output plug (shown in FIG. 2C) via the first switch unit 171 and the second switch unit 173 so that the external display device displays images included in the TV output signal 110.

Likewise, the processing circuit 15 outputs a right sound channel audio signal 102 to the right sound channel contact R of the stereo output plug (shown in FIG. 2C) via the right sound channel audio output contact 153, and also outputs a left sound channel audio signal 104 to the left sound channel contact L of the stereo output plug (shown in FIG. 2C) via the left sound channel audio output contact 155. Thereby, in addition to outputting the TV output signal 110, the stereo output plug with the TV output function as depicted in FIG. 2C can also output a stereo audio signal comprising the right sound channel audio signal 102 and the left sound channel audio signal 104.

If the voltage value 100 of the contact 21 of the plug plugged into the connector 13 does not fall between the first and the second predetermined value (i.e., between 0 to 2.6 V), this indicates that the plug belongs to none of the aforesaid three kinds of plugs (i.e., the stereo earphone plug, the stereo earphone plug with a microphone function and the stereo output plug with a TV output function). Then, the portable electronic apparatus 1 will inform the user that the plug plugged in the connector 13 cannot be recognized through screen displaying or sound alerting. Preferably, the processing circuit 15 should read the voltage value 100 again via the plug voltage input contact 163, and if the voltage value 100 still falls outside of 0 to 2.6 V, the user will be informed again that the plug plugged in the connector 13 cannot be recognized.

It should be noted that although two signal lines are used to transmit the first switch signal 150 and the second switch signal 152 respectively in FIG. 1 and FIGS. 3 to 6, this invention is not limited to the transmission of the first switch signal 150 and the second switch signal 152 through separate signal lines. More specifically, the first switch unit 171 may be designed to be controlled by a "high level" and a "low level" of a signal so as to electronically connect the connector 13 to the second switch unit 173 or connect the connector 13 to the plug voltage input contact 163 of the processing circuit 15, that is, the high level represents the first switch signal 150 while the low level represents the second switch signal 152. In this way, only a single signal line is needed to control whether to electronically connect the connector 13 to the second switch unit 173 or to the plug voltage input contact 163 of the processing circuit 15.

Likewise, although these two signal lines are used to transmit the third switch signal 154 and the fourth switch signal 156 respectively in FIG. 1 and FIGS. 3 to 6, they may also be transmitted via a single signal line in the aforesaid manner. The method in which the third switch signal 154 and the fourth switch signal 156 are transmitted via a single signal line will be readily appreciated by those of ordinary skill in the art based on the above description, and thus will not be further described herein.

It should be noted that although a voltage value of 0 to 2.6V for the contact 21 is used to determine different kinds of plugs in the aforesaid signal input/output devices, those of ordinary skill in the art may also use other voltage values and voltage ranges to determine various different kinds of plugs based on the above description, and therefore, this will not be further described herein.

Figure 7:
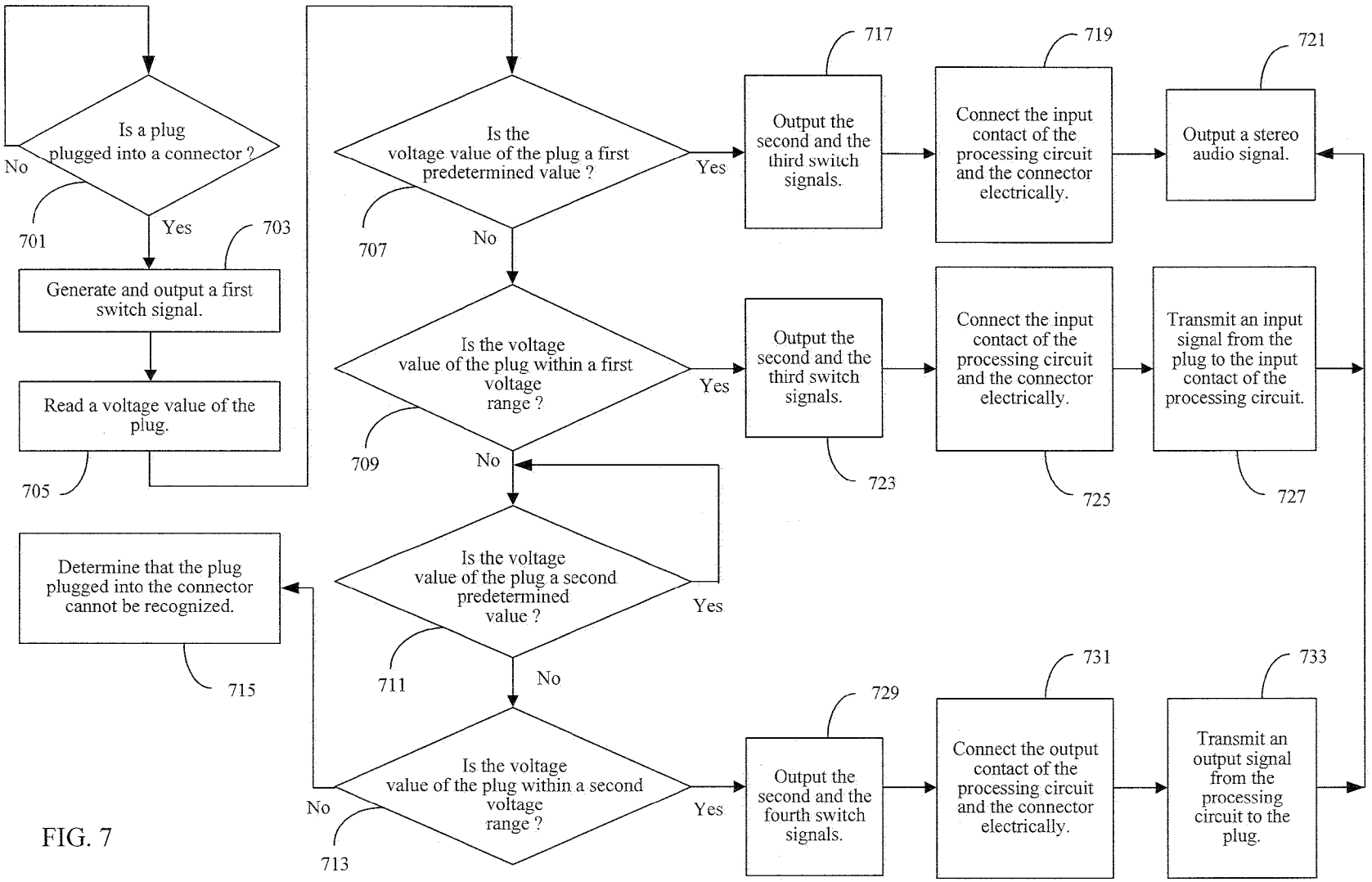
FIG. 7 is a flowchart of a connection method according to another preferred embodiment of this invention.

FIG. 7 depicts a connection method for a portable electronic apparatus according to another preferred embodiment of this invention. This method is applicable to the portable electronic apparatus 1 according to the previous preferred embodiment, and comprises the following steps. Initially, it is detected whether a plug is plugged into a connector via step 701. If not, step 701 will be continuously executed to detect whether a plug is plugged into the connector. Otherwise, if a plug is plugged into the connector, in step 703, a first switch signal is generated and outputted to enable a first switch unit to electronically connect a plug voltage input contact of the processing circuit and the connector to form a first connection path. Then, the processing circuit is enabled to read a voltage value of the plug via the first switch unit in step 705.

Next, via step 707, it is determined whether the voltage value of the plug is a first predetermined value (i.e., 0 V). If the voltage value of the plug is not the first predetermined value, it is determined whether the voltage value of the plug falls within a first voltage range (i.e., 0.3 to 2.5 V) in step 709. If the voltage value of the plug falls outside of the first voltage range, it is determined whether the voltage value of the plug is a second predetermined value (i.e., 2.6 V) via step 711. If the voltage value of the plug is not the second predetermined value, it is determined whether the voltage value of the plug falls within a second voltage range (i.e., 0.12 to 0.2 V) in step 713. If the voltage value of the plug falls outside of the second voltage range, the user will be informed that the plug plugged into the connector cannot be recognized in step 715.

If the voltage value of the plug is determined to be the first predetermined value in step 707, the plug plugged into the connector is a stereo earphone plug. Then, a second switch signal and a third switch signal are generated and outputted to the first switch unit and the second switch unit respectively in step 717. Afterwards, an input contact of the processing circuit and the connector are electronically connected via the first switch unit and the second switch unit in step 719. Finally, a stereo audio signal comprising a right channel audio signal and a left sound channel audio signal is outputted in step 721.

If the voltage value of the plug is determined within the first voltage range in step 709, the plug plugged into the connector is a stereo earphone plug with a microphone function. Then, a second switch signal and a third switch signal are generated and outputted to the first switch unit and the second switch unit respectively to form a second connection path in step 723. Next, the input contact of the processing circuit and the connector are electronically connected via the first switch unit and the second switch unit via step 725. In step 727, an input signal from the plug (i.e., a microphone audio input signal) is transmitted to the input contact of the processing circuit via the second connection path. Finally, a stereo audio signal comprising both a right sound channel audio signal and a left sound channel audio signal is outputted to the plug in step 721.

If the voltage value of the plug is determined to be the second predetermined value in step 711, the plug plugged into the connector is a stereo output plug with a TV output function but has not been connected to a display device. Then, step 711 is continuously executed to determine whether the stereo output plug with the TV output function has been connected to the display device.

If the voltage value of the plug is determined within the second voltage range in step 713, the plug plugged into the connector is a stereo output plug with a TV output function and has been connected to a display device. In step 729, a second switch signal and a fourth switch signal are generated and outputted to the first switch unit and the second switch unit respectively to form another second connection path. Afterwards, the output contact of the processing circuit and the connector are electronically connected via the first switch unit and the second switch unit in step 731. Next, an output signal from the processing circuit (i.e., a TV output signal) is transmitted to the plug via said another second connection path in step 733. Finally, a stereo audio signal comprising both a right sound channel audio signal and a left sound channel audio signal is outputted to the plug in step 721.

In addition to the aforesaid steps, the connection method can also execute all the operations and functions set forth with respect to the aforesaid portable electronic apparatus 1 of this invention. The process flow shown in FIG. 7 that executes these operations and functions will be readily appreciated by those of ordinary skill in the art based on the explanation of portable electronic apparatus 1 of this invention, and thus will not be further described herein.

According to the above descriptions, the portable electronic apparatus and the connection method therefore disclosed in this invention primarily utilize the fact that different kinds of plugs have different characteristic output voltage values. By reading the voltage value of the plug, the present invention enables the processing circuit to output corresponding switch signals, so that the switch module within the portable electronic apparatus perform appropriate switching operations to electronically connect corresponding contacts, thereby switching between outputting a video signal or inputting a microphone signal. Accordingly, by using only a single connector, this invention solves the problem of unnecessarily high costs and increased space occupation on the circuit board incurred by requiring different kinds of connectors in the prior art.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A connection method for a portable electronic apparatus, the portable electronic apparatus comprising a connector, a processing circuit and a switch module, the connection method comprising:

detecting whether a plug is plugged into the connector;

generating a first switch signal when the plug is plugged into the connector;

enabling the switch module to form a first connection path according to the first switch signal, so that the plug and the processing circuit are electronically connected;

reading a voltage value from the plug via the first connection path;

generating a second switch signal according to the voltage value;

enabling the switch module to form a second connection path according to the second switch signal, so that the plug and the processing circuit are electronically connected; and transmitting one of an input signal from the plug and an output signal from the processing circuit via the second connection path.

2. The connection method of claim 1, further comprising:

generating and outputting the second switch signal and a third switch signal when the voltage value of the plug is determined as a first predetermined value; and electronically connecting an input contact of the processing circuit and the connector according to the second and the third switch signals.

3. The connection method of claim 2, further comprising:

generating and outputting the first switch signal and a fourth switch signal when the voltage value of the plug is determined as a second predetermined value; and electronically connecting an output contact of the processing circuit and the connector according to the fourth switch signal.

4. The connection method of claim 1, wherein the step of enabling the switch module to form the first connection path further comprises:

electronically connecting the processing circuit and the connector via a first switch unit of the switch module according to the first switch signal; and reading the voltage value of the plug via the first switch unit.

5. The connection method of claim 4, wherein the step of enabling the switch module to form the second connection path further comprises:

electronically connecting a second switch unit of the switch module and the connector via the first switch unit according to the second switch signal;

generating and outputting a third switch signal when the voltage value of the plug is determined to be within a first voltage range;

electronically connecting an input contact of the processing circuit and the first switch unit via the second switch unit according to the third switch signal;

transmitting the input signal of the plug to the second switch unit via the first switch unit; and transmitting the input signal of the plug to the input contact of the processing circuit via the second switch unit.

6. The connection method of claim 5, wherein the input contact is a microphone audio input contact.

7. The connection method of claim 4, wherein the step of enabling the switch module to form the second connection path further comprises:

electronically connecting a second switch unit of the switch module and the connector via the first switch unit according to the second switch signal;

generating and outputting a fourth switch signal when the voltage value of the plug is determined to be within a second voltage range;

electronically connecting an output contact of the processing circuit and the first switch unit via the second switch unit according to the fourth switch signal;

transmitting the output signal of the processing circuit from the output contact of the processing circuit to the first switch unit via the second switch unit; and transmitting the output signal of the processing circuit to the connector via the first switch unit.

8. The connection method of claim 7, wherein the output contact is a TV-OUT contact.

9. A portable electronic apparatus, comprising:

a connector being configured to connect a plug;

a processing circuit, electronically connected to the connector, being configured to detect whether the plug is plugged into the connector, wherein the processing circuit generates a first switch signal when the plug is plugged into the connector; and a switch module being configured to receive the first switch signal and to form a first connection path according to the first switch signal, so that the plug and the processing circuit are electronically connected, wherein the processing circuit reads a voltage value from the plug via the first connection path and generates a second switch signal according to the voltage value, the switch module forms a second connection path according to the second switch signal, so that the plug and the processing circuit are electronically connected, and the processing circuit transmits one of an input signal from the plug and an output signal from the processing circuit via the second connection path.

10. The portable electronic apparatus of claim 9, wherein the processing circuit generates and outputs the second switch signal and a third switch signal to the switch module when the processing circuit determines that the voltage value of the plug is a first predetermined value, and the switch module electronically connects an input contact of the processing circuit and the connector according to the second and the third switch signals.

11. The portable electronic apparatus of claim 10, wherein the processing circuit generates and outputs the first switch signal and a fourth switch signal to the switch module when the processing circuit determines that the voltage value of the plug is a second predetermined value, and the switch module electronically connects an output contact of the processing circuit and the connector according to the fourth switch signal and reads the voltage value of the plug according to the first switch signal.

12. The portable electronic apparatus of claim 9, wherein the switch module further comprises:

a first switch unit being configured to electronically connect the connector and the processing circuit according to the first switch signal to form the first connection path, wherein the processing circuit reads the voltage value of the plug via the first switch unit according to the first switch signal when the switch module receives the first switch signal.

13. The portable electronic apparatus of claim 12, wherein the switch module further comprises:

a second switch unit, wherein the processing circuit generates and outputs a third switch signal when the processing circuit determines that the voltage value of the plug is within a first voltage range;

the first switch unit receives the second switch signal to electronically connect the second switch unit and the connector, and the second switch unit receives the third switch signal to electronically connect an input contact of the processing circuit and the first switch unit; and the input signal of the plug is transmitted from the connector to the second switch unit via the first switch unit and then transmitted to the input contact of the processing circuit via the second switch unit.

14. The portable electronic apparatus of claim 13, wherein the input contact is a microphone audio input contact.

15. The portable electronic apparatus of claim 12, wherein the switch module further comprises:

a second switch unit, wherein the processing circuit generates and outputs a fourth switch signal when the processing circuit determines that the voltage value of the plug is within a second voltage range;

the first switch unit receives the second switch signal to electronically connect the second switch unit and the connector, and the second switch unit receives the fourth switch signal to electronically connect an output contact of the processing circuit and the first switch unit; and the output signal of the processing circuit is transmitted from the output contact of the processing circuit to the first switch unit via the second switch unit and then transmitted to the connector via the first switch unit.

16. The portable electronic apparatus of claim 15, wherein the output contact is a TV-OUT contact.

* * * * *